US006062441A

United States Patent [19]

Mengeu et al.

[11] Patent Number: 6,062,441

[45] Date of Patent: May 16, 2000

[54] TWO-PIECE DISPENSING CLOSURE

[75] Inventors: Gary Lee Mengeu; Scott Alan Hand, both of Wheeling, W. Va.

[73] Assignee: RXI Plastics, Inc., Triadelphia, W. Va.

[21] Appl. No.: 09/354,620

[22] Filed: Jul. 15, 1999

[51] Int. Cl.[7] ..... B67D 3/00

[52] U.S. Cl. ..... 222/521

[58] Field of Search ..... 222/520, 519, 222/521, 507, 563

[56] References Cited

U.S. PATENT DOCUMENTS

| | | | |
|---|---|---|---|
| 3,058,631 | 10/1962 | de la Hitte . | |
| 3,578,223 | 5/1971 | Armour | 222/521 |
| 4,867,354 | 9/1989 | Schreiber . | |
| 4,946,080 | 8/1990 | Vesborg | 222/521 X |
| 5,044,403 | 9/1991 | Chen . | |
| 5,275,338 | 1/1994 | Tobler . | |
| 5,305,932 | 4/1994 | Iseli . | |
| 5,715,977 | 2/1998 | Goncalves | 222/521 |
| 5,947,331 | 9/1999 | Goncalves | 222/521 X |

FOREIGN PATENT DOCUMENTS

| | | | |
|---|---|---|---|
| WO97/39961 | 4/1996 | France | 222/521 |

*Primary Examiner*—Kevin Shaver
*Assistant Examiner*—Thach Bui
*Attorney, Agent, or Firm*—David W. Brownlee; Richard V. Westerhoff; Eckert Seamans Cherin & Mellott, LLC

[57] ABSTRACT

A two-piece dispensing closure is disclosed, which includes a plastic fitment that fits in the mouth of a bottle, a twist type over cap having a central aperture in its top wall for engagement with a post on the top of the fitment and having a sealing wall and lip for sealing over holes through a bottom wall of the fitment.

12 Claims, 6 Drawing Sheets

TWO-PIECE DISPENSING CLOSURE

BACKGROUND OF THE INVENTION

1. Field of the Invention

This invention relates to closures for dispensing liquid or semi-liquid products from bottles, and particularly to a two-piece dispensing closure that includes a plastic fitment for insertion into a bottle mouth and a plastic cap that is rotatable to open and close a dispensing opening in its top wall.

2. Description of the Prior Art

It is well known to provide caps and closures for containers of liquid and semi-liquid products such as water, soap, syrup, catsup, household cleansers, waxes and the like. Such dispensing caps are typically opened by twisting them, lifting a flip-top lid, or by pulling them upwardly to open an aperture in the top of the cap. The caps may include means for making them child resistant and/or pilfer resistant.

One such cap is disclosed in U.S. Pat. No. 5,305,932 to Andreas Iseli. That patent discloses a container having a neck with an integral neck top on it, an upwardly projecting post on top of the neck, and a plurality of apertures around the post for discharge of the contents of the container. Iseli's cap has a top wall with a central aperture in it for sealing engagement with the post on the container, an inner skirt with a flexible lip seal for sealing against the cylindrical container neck, and a plurality of lugs for engaging in a helical groove in the container neck to hold the cap in rotational engagement with the container neck. The central aperture in the cap has a lower annular lip on it for seating in an undercut groove in the projecting post on the container neck.

U.S. Pat. No. 4,867,354 to Alexander Schreiber discloses a dispensing outer cap for fitting over an inner cap that is engaged inside the mouth of a container. The inner cap has a plug on it for sealing engagement in a dispensing aperture in the top wall of the outer cap. The inner cap has a flow channel around the plug and has a cylindrical support wall and sealer intrusion chamber for receiving an internal sealer sleeve on the outer cap.

Dispensing caps are also disclosed in U.S. Pat. Nos. 3,058,631, 5,044,403 and 5,275,338, among others.

An improved dispensing cap is needed that provides improved sealing of the dispensing opening when the cap is closed and thereby reduces the risk of leakage of the contents of the container should the container be tipped on its side or upside down during shipment or use. Leakage of product can result in considerable loss, especially if the container is in a carton of multiple containers. Leakage from one container can result in some or all the containers in the carton having leaked contents on them and not marketable.

An improved dispensing cap is also needed that is economical to manufacture and that also has improved leak resistance. Small savings in the cost of packing can save many thousands of dollars when the products are sold in large volumes as are many food and household products.

SUMMARY OF THE INVENTION

This invention provides a two-piece dispensing closure that includes a plastic fitment for fitting in the mouth of a bottle, and a plastic cap that fits over the fitment and the container mouth, and which has a central dispensing opening in the top of the cap for sealing engagement with a center post on the fitment. The fitment has a bottom wall in it with a plurality of holes through it for flow of product through the fitment, and the cap has a downwardly projecting sealing wall for sealing the holes when the dispensing closure is closed. The cap further has means associated with it and with the container for raising and lowering the cap on the container by twisting of the cap and means for limiting such twisting to about one-quarter turn. This dispensing closure has a double seal that greatly improves resistance to accidental leakage of product.

Accordingly, an object of this invention is to provide an improved dispensing closure for containers of liquid and semi-liquid products.

The above and other advantages and objectives of the invention will be more fully understood and appreciated with reference to the following description and drawings.

DESCRIPTION OF THE PREFERRED EMBODIMENT

A two-piece dispensing closure of this invention is designed for use on containers for products that are not pressurized. The contents of the containers are typically liquid or semi-liquid products, which can be dispensed by inverting the bottle. The bottle may be squeezed to expel the product through the dispensing closure in its open position. The bottle is preferably flexible plastic to permit such squeezing, but could also be glass or metal if the product is sufficiently low in viscosity to flow from the bottle without being expelled by squeezing the bottle.

Figure 1:
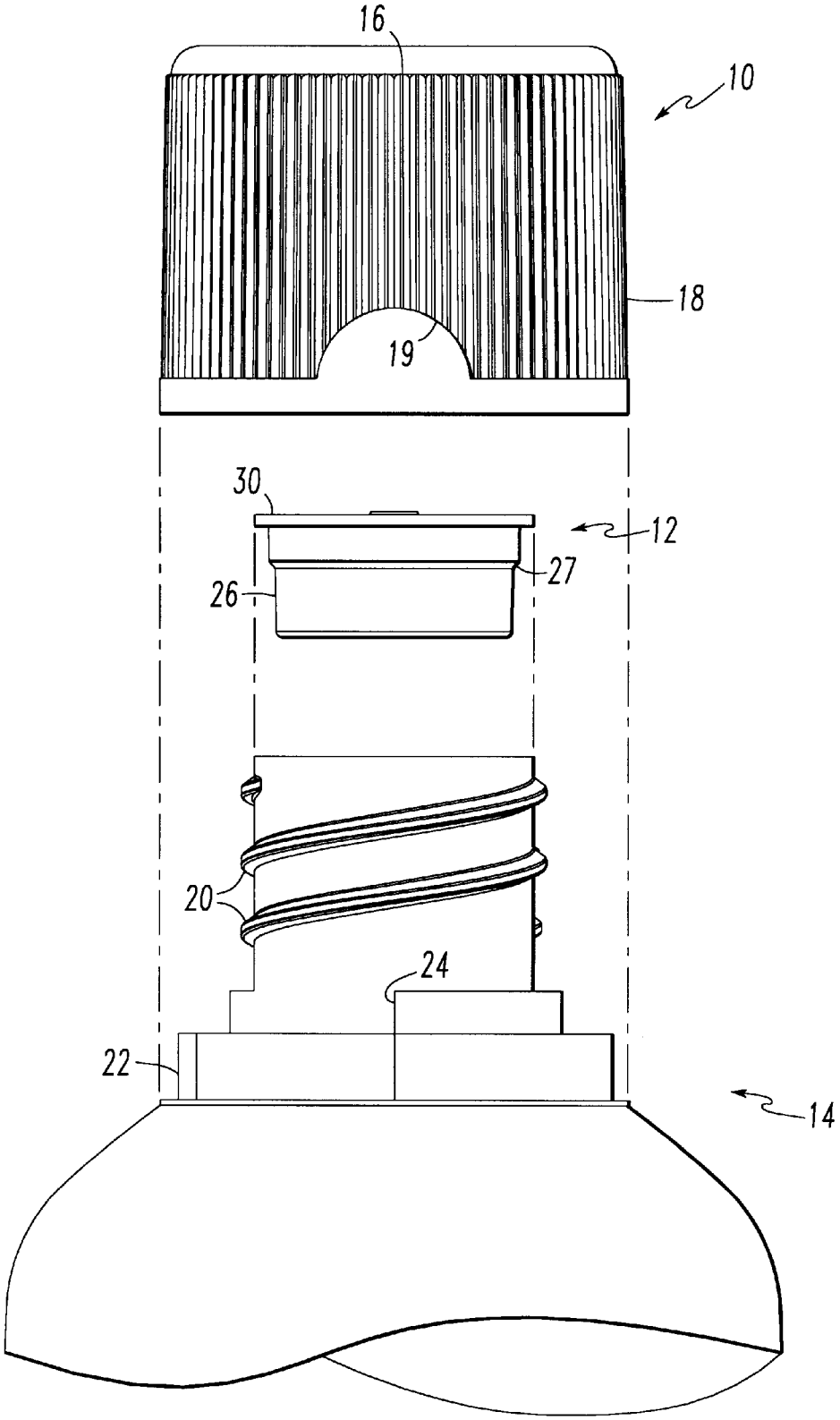
FIG. 1 is a side view of the components of a two-piece dispensing closure of this invention showing the outer cap positioned above the fitment, which is shown above the neck of a bottle for receiving the dispensing closure.

Referring to FIG. 1, a preferred embodiment of a two-piece dispensing closure is shown as including a plastic outer cap 10 and a plastic fitment 12 for closing a container neck 14. The cap 10 is preferably injection or compression molded and has a plurality of vertical serrations on ribs 16 in its outer skirt 18 for facilitating gripping of the cap to twist it between its closed and open positions on the bottle. The skirt 18 preferably has diametrically opposed unserrated half moons or other markings on it to indicate where finger pressure should be applied to squeeze the cap as is explained below.

The fitment 12 is preferably injection molded and is dimensioned to fit into and be retained in the mouth opening of the bottle 14. The outside diameter of the fitment is preferably greater than the inside diameter of the mouth opening to provide an interference fit therebetween. The interference fit can also be enhanced by a bead, not shown, around the outside surface of the fitment. The fitment 12 has an outer wall 26, an outwardly projecting flange 30 around the top of the outer wall, and a center post as best seen in FIGS. 3 and 4.

Figure 2:
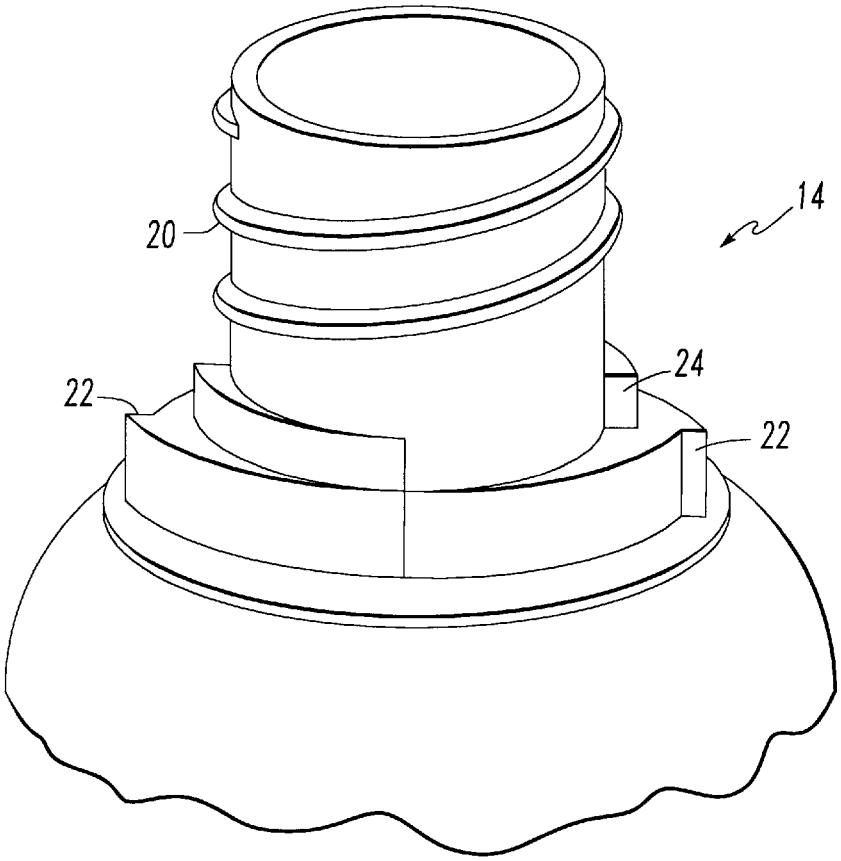
FIG. 2 is a perspective view of the neck of the bottle of FIG. 1.

The bottle neck 14 is preferably cylindrical and has an inclined thread 20 or lugs on its outer cylindrical surface to engage a thread or lugs in the outer cap 10 as is described below. The bottle neck may be inclined to vertical for convenience of pouring, or may be vertical as is more conventional. As best seen in FIG. 2, the bottle neck 14 preferably has two teeth 22 on it for engaging diametrically opposed teeth on the inside of the cap 10 and at least one stop member 24 on the neck above the teeth 22 for engaging stop members on the inside of the cap as is also described below.

Figure 3:
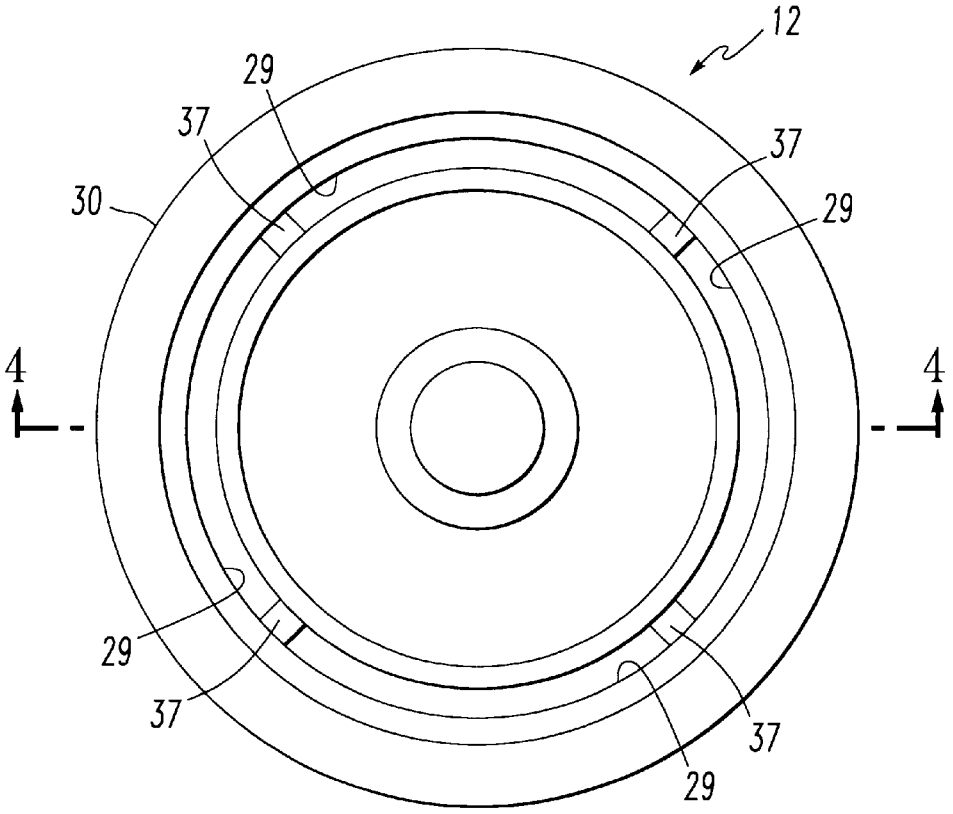
FIG. 3 is a top view of the fitment for a dispensing closure of this invention.
Figure 4:
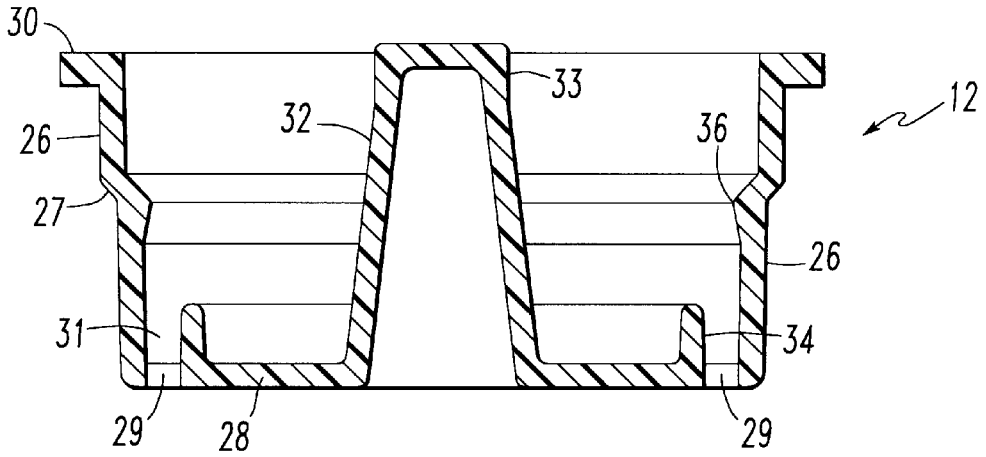
FIG. 4 is a vertical cross-sectional view through the fitment of FIG. 3, taken along line 4—4 in FIG. 3.

The fitment 12 member is more fully illustrated in FIGS. 3 and 4 as including an outer wall 26, a bottom wall 28, an outwardly projecting flange 30 around the top of the wall 26, a center post 32 projecting upwardly from the bottom wall 28, an annular sealing rim 34 projecting upwardly from the bottom wall adjacent its juncture with the outer wall, and an annular inwardly projecting rim 36 on the inside surface of the outer wall 26 above the top of the sealing rim 34. The outer wall 26 may include an upwardly, outwardly include step or shoulder 27 at about the midpoint in the wall to help retain the fitment in a bottle mouth. The sealing wall 34, outer wall 26 and bottom wall 28 cooperate to form an annular channel 31 around the bottom of the fitment 12. The bottom wall 28 further has a plurality of flow apertures 29 though it in the channel 31 between the sealing rim 34 and the outer wall 26. Each aperture 29 preferably extends for about 70–80° around the fitment. The apertures 29 are separated bridges 37 between them.

Figure 5A:
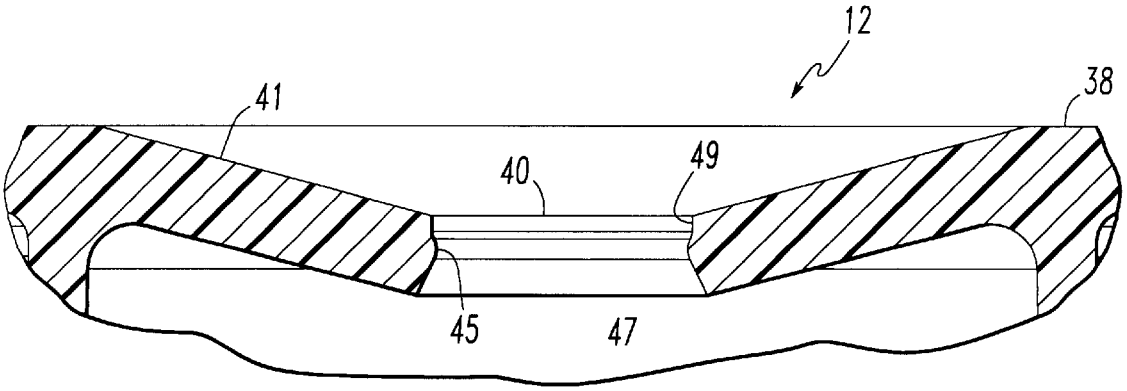
FIG. 5A s a greatly enlarged fragmentary view of a portion of the top wall of the cap, identified as 5A and FIG. 5.
Figure 5:
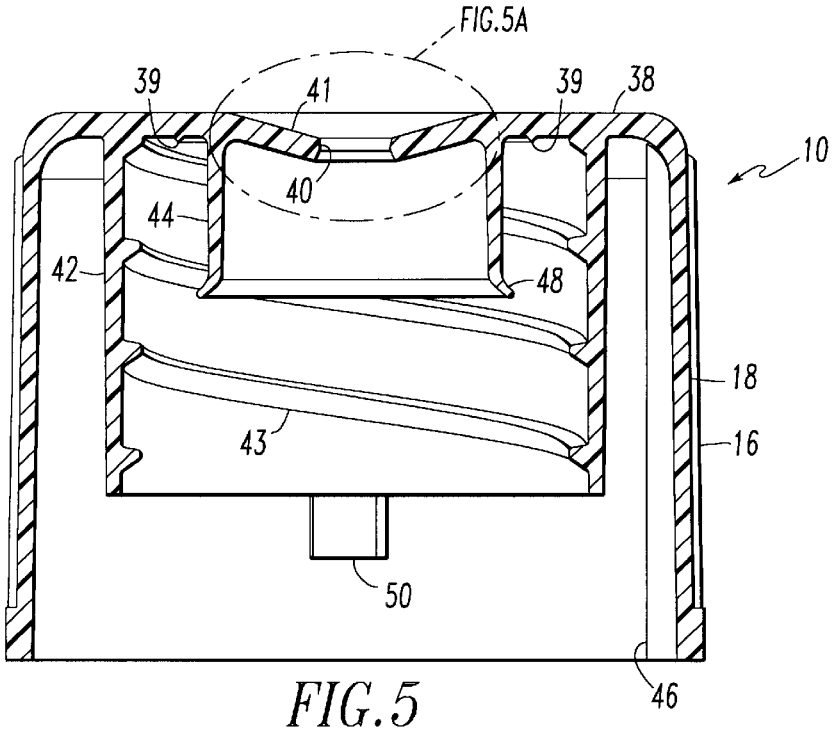
FIG. 5 is a vertical cross-sectional view through the cap for a dispensing closure of this invention.
Figure 6:
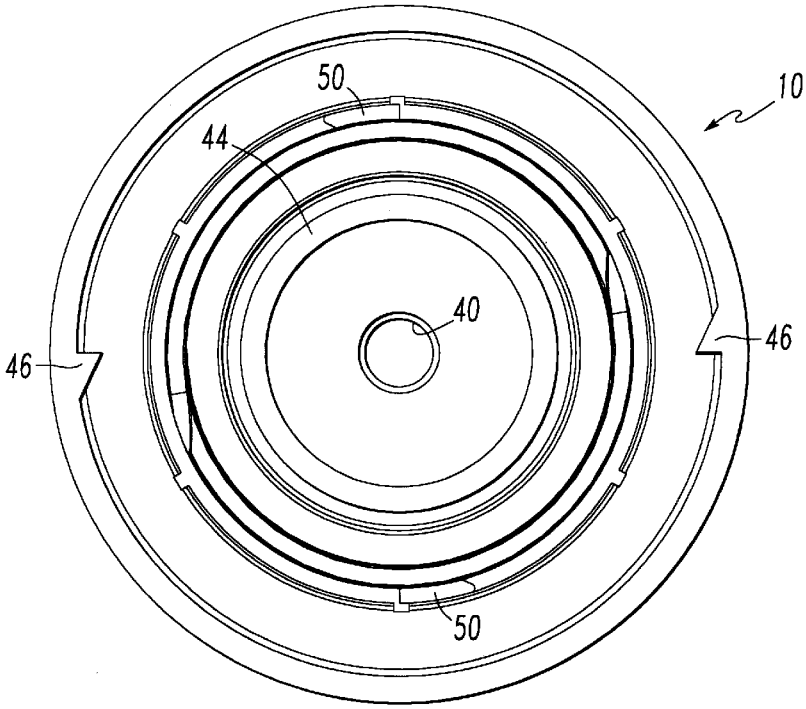
FIG. 6 is a bottom view of the cap of FIG. 5.

The center post 32 in the fitment 12 is preferably hollow, to conserve on material, but could be solid. The post 32 preferably has a cylindrical top portion 33 and tapers slightly outwardly toward its bottom and the bottom wall 28. The top corner of the post 32 may optionally have a 45° bias on it around its perimeter to help guide the post into an aperture 40 in the top of the cap 12 (FIGS. 5 and 6). The top corner of the post 32 may alternatively be rounded or have other angles on the bias.

The outer cap 10 is more fully illustrated in FIGS. 5 and 6 as including a cylindrical outer wall/skirt 18, a top wall 38 having a central aperture 40 in it, a cylindrical intermediate wall 42 having an internal thread 43 and two diametrically opposed stop members 50 on its inner surface, and cylindrical sealing wall 44 between the intermediate wall 42 and the aperture 40. The sealing wall 44 has a downwardly and outwardly projecting sealing lip 48 on its bottom terminal edge. The top wall 38 preferably has a downwardly projecting annular bead 39 on it for sealing against the top of the flange 30 on fitment 12 as is described below.

The top wall 38 preferably has a recessed central portion 41 with the aperture 40 located in its center. The recessed portion 41 is flexible to help enhance the seal between the aperture 40 and the post 32 on the fitment 12 as is explained below. As best seen in FIG. 5A, the aperture 40 may have a generally frustoconical lower surface 47 which is slightly larger than the top of the post 32, an annular sealing bead 45 which is slightly smaller than the top of the post, and an upper diameter 49 which is also larger than the top of the post.

The outer wall 18 of the cap 12 preferably has two inwardly directed diametrically opposed teeth 46 on it for engaging the teeth 22 on the bottle 14 (FIG. 1). The teeth 22 on the bottle and teeth 46 on the skirt operate to make the cap 10 child resistant. The skirt 18 of the cap 10 must be squeezed on opposite sides between the teeth 46 to disengage the teeth 46 on the cap 10 from the teeth 22 on the bottle 14 and permit twisting or rotation of the cap on the bottle. Marks, such as the unserrated half moons 19, are provided on the skirt 18 to identify where the skirt 18 should be squeezed. Squeezing the cap 12 at such marks flexs the skirt 18 into an elliptical shape to release the teeth 22 on the cap from the teeth 22 on the bottle neck. The thread 43 on the intermediate wall 42 engages the thread 20 on the bottle neck 14 and causes the cap 10 to move up and down on the bottle neck when the cap is rotated or twisted on the bottle neck.

The dispensing closure of this invention is not designed to be removed from the bottle neck 14. The outer cap 10 preferably has two integral stop members 50 projecting downwardly from the intermediate wall 42 to engage stop members or lugs 24 on the bottle neck 14 to limit twisting of the cap 10 on the bottle neck 14 to about a one-quarter turn (90°). The stop members 24 and 50 and threads 20 and 43 on the bottle neck 14 and cap 12 are dimensioned and positioned such that the stop members will engage and stop further twisting of the cap after it has been twisted about 90° counterclockwise from the closed position of the cap on the bottle. Once the two-piece dispensing closure is secured on a bottle, the outer cap 10 is twisted about one-quarter turn to open and close the dispensing closure as is further described below. Bottles having dispensing closures of this invention on them are typically not reused.

Figure 7:
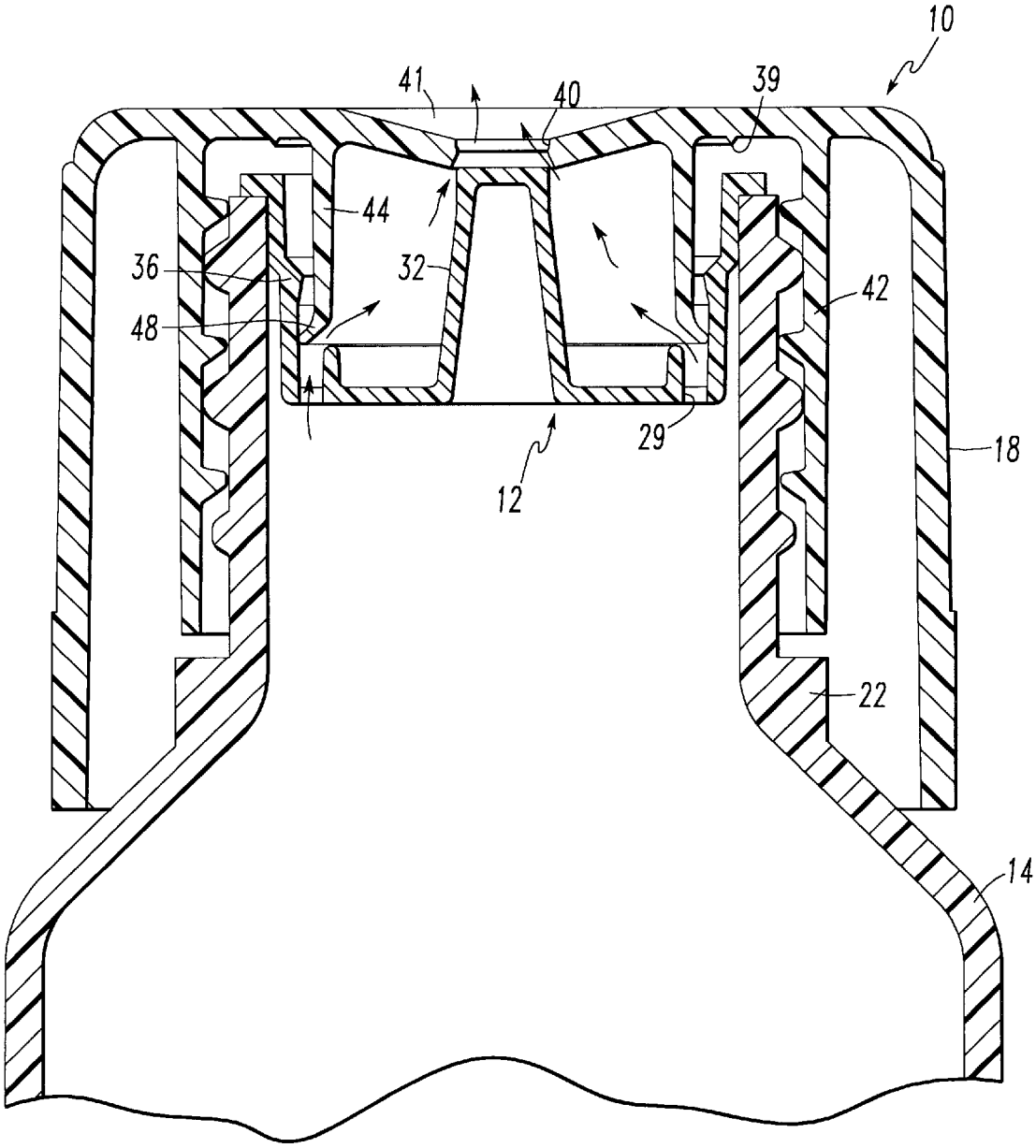
FIG. 7 is a cross-sectional view through a dispensing closure of this invention on a bottle and showing the closure in the open position.

FIG. 7 shows a dispensing closure 10 of this invention as a bottle neck 14 with the closure in the open position. As seen in this figure, the fitment 12 is secured in the bottle neck 14, and the outer cap 10 is secured on the bottle neck over the fitment and is in a raised position on the neck. In this position, the sealing lip 48 on the cap 10 is seated against the underside of rim 36 on the fitment 12 to prevent product from flowing between the sealing wall 44 of the cap and the outer wall of the fitment. The arrows show the flow of product from the bottle and through the dispensing closure. For clarity, the package is shown in the upright position instead of the inverted position for product flow and dispensing by gravity and/or squeezing of the bottle. After product has been dispensed, the package is returned to the upright position, and most of the product that may remain in the fitment 12 can drain through the apertures 29 back into the bottle.

Figure 8:
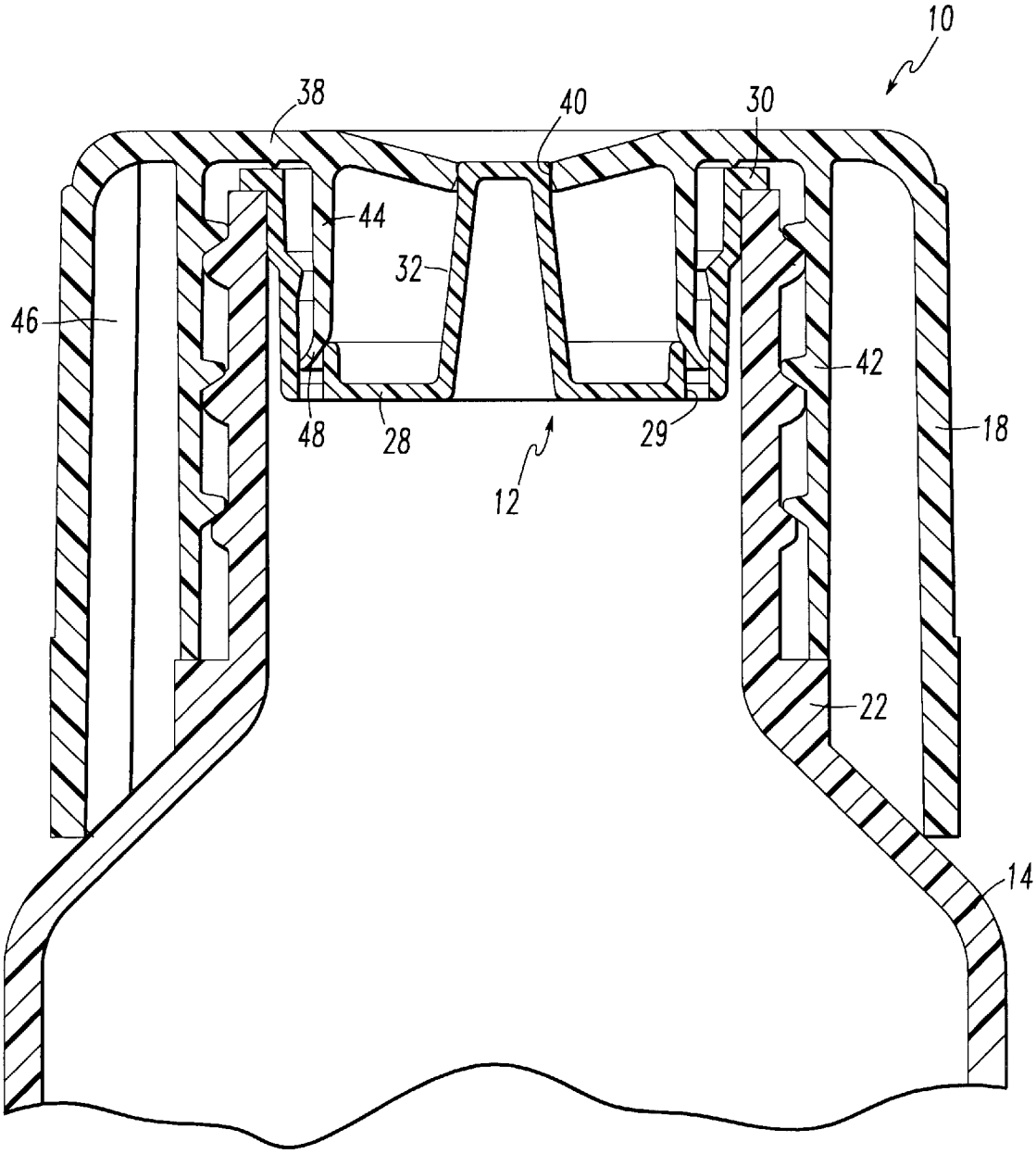
FIG. 8 is a cross-sectional view similar to FIG. 7, except showing the closure in the closed position.

FIG. 8 is similar to FIG. 7 except the dispensing closure is shown in the closed position with the outer cap 10 twisted to its closed/down position on the bottle neck 14. In this position, the top of the center post 32 on the fitment 12 is seated in the aperture 40 in the top wall 38 of the outer cap 10, and the sealing lip 48 on sealing wall 44 on the cap 10 is sealingly engaged in the channel in the fitment to close/seal the holes 29 through the bottom wall 28 of the fitment. In the embodiment selected for illustration, the fitment 12 and cap 10 are sized so that the post 32 will enter the aperture 40 in the cap and cause the flexible recessed portion 41 (FIG. 7) in the top wall of the cap to flex upwardly. This upward flexing causes the sealing bead 45 in the aperture 40 to tightly seal with the cylindrical top portion 33 of the post 32. There is a double or triple seal of the outer cap 10 with the fitment 12. One seal is between the post 32 and top wall 38, and the other seals are between the sealing lip 48 and the bottom of the channel 31 and between the annular bead 39 on the undersurface of the top wall 38 of the cap 10 and the top surface of the flange 30 on the fitment 12.

To open the dispensing closure, the skirt 18 of cap 10 is squeezed on opposite sides at the unserrated half moons 19 to release teeth 46 from engagement with the teeth 22 on the bottle, and the cap is rotated or twisted about one-quarter turn counterclockwise. At this point, further twisting of the cap 10 on the bottle neck 14 is resisted/prevented by engagement of the stop members 50 on the cap with the stop members 46 on the bottle. The one-quarter twist of the cap 10 raises the cap on the bottle neck 14 to the open position shown in FIG. 6.

It is therefore seen that a preferred embodiment of an improved two-piece dispensing closure is provided, which has a double seal against accidental leakage of the product. There are, of course, many modifications that can be made to such preferred embodiments without departing from the invention or the scope of the claims appended hereto.

We claim:

1. A two-piece closure for dispensing liquids or semi-liquids from a container having a generally cylindrical neck portion, which has inclined closure retaining means on it, said closure comprising:

a plastic fitment for insertion into an open mouth of said neck portion of a container and having a generally cylindrical outer wall, a bottom wall and a cylindrical center post projecting upwardly from said bottom wall, said bottom wall having at least one hole through it adjacent its juncture with said outer wall; and a plastic cap for securement over said container neck, said cap having a cylindrical wall portion with inclined cam means on the inside surface of said wall portion for engaging said inclined closure retaining means on said container neck, said cap further having a top wall with a central aperture in it for receiving said center post on said fitment and sealing therewith, and a cylindrical downwardly extending sealing wall between said cylindrical wall portion and said aperture for sealing against an inner sealing surface on said outer wall of said fitment, said sealing wall having a bottom terminal end for closing said at least one hole in the bottom wall of said fitment, and said cap being rotatable on said container neck for said closure retaining means on the container neck and inclined cam means on said cap to move the cap up and down with respect to said container neck and said fitment in the container neck to open and close said at least one opening in the bottom wall of the fitment and open and close said aperture in said top wall of the cap.

2. A two-piece plastic closure as set forth in claim 1 in which said fitment further includes an upwardly projecting annular sealing rim on said bottom wall adjacent said outer wall for engaging against an inner surface on the sealing wall on said cap when the cap is rotated to close said at least one hole in the bottom wall of said fitment.

3. A two-piece plastic closure as set forth in claim 1 in which said cap includes means for limiting the rotation of the cap on a container.

4. A two-piece plastic closure as set forth in claim 3 in which said limiting means comprises at least one stop member for engaging at least one mating stop member on said container neck to limit rotation of the cap to about one-quarter turn.

5. A two-piece plastic closure as set forth in claim 1 in which said cap has an outer skirt projecting downwardly from an outer edge of said top wall, said skirt having diametrically opposed teeth on its inner surface for engaging teeth on the outer surface of said container neck to prevent rotation of said cap unless said skirt is squeezed on opposite sides thereof intermediate said diametrically opposed teeth on the skirt.

6. A two-piece plastic closure as set forth in claim 1 in which said cap has an annular bead on the undersurface of said top wall for sealing against an annular flange around the top of said fitment.

7. A dispensing package comprising:

a container having a cylindrical neck portion with a mouth opening in it and an inclined thread on its outer surface;

a plastic fitment retained in said mouth opening, said fitment having a generally cylindrical outer wall, a bottom wall, an annular sealing rim projecting upwardly from said bottom wall and forming an annular sealing channel in said fitment, a plurality of holes through said bottom wall in said channel, and a center post projecting upwardly from said bottom wall; and a plastic cap secured on said container neck portion over said fitment, said cap having a cylindrical wall portion with inclined thread in it engaging said thread on said bottle neck portion, a top wall having a central aperture in it for receiving said center post on the fitment and sealing therewith when the cap is in the closed position, a cylindrical downwardly extending sealing wall between said cylindrical wall portion and said aperture, said sealing wall having an outwardly and downwardly projecting sealing lip on its terminal end for closing said channel in said fitment and the holes through the said bottom wall of the fitment when said cap is in its closed position, and whereby twisting said cap counterclockwise on said neck portion raises said cap on the neck portion to open said aperture through the top wall of the cap and said holes through said bottom wall of the fitment to permit product to be dispensed therethrough.

8. A dispensing package as set forth in claim 7 in which said cap and said bottle neck portion have cooperating means for limiting twisting of said cap to about one quarter turn from the fully closed position of the cap on the neck portion.

9. A dispensing package as set forth in claim 7 in which said bottle neck position has teeth on it, said cap has an outer depending skirt having opposed teeth on its inner surface for engaging said teeth on said neck portion to prevent rotation of sid cap unless said skirt is squeezed on opposite sides thereof intermediate said diametrically opposed teeth.

10. A dispensing package as set forth in claim 6 in which said plastic cap has an annular bead on the undersurface of its top wall for sealing against the top surface of an annular flange around the top of said fitment.

11. A two-piece closure as set forth in claim 1 in which said plastic cap has a recessed central portion around said central aperture in said top wall to enhance sealing between the aperture and said center post on said fitment when said recessed central portion is flexed upwardly when said closure is rotated to the closed position on a container.

12. A dispensing package as set forth in claim 7 in which said plastic cap has a recessed central portion around said central aperture in said top wall to enhance sealing between the aperture and said center post on said fitment when said recessed central portion is flexed upwardly when said closure is rotated to the closed position on a container.

* * * * *